US008151481B2

(12) United States Patent
Perez, Jr.

(10) Patent No.: US 8,151,481 B2
(45) Date of Patent: Apr. 10, 2012

(54) UNIVERSAL HAND-HELD HAIR DRYER HOLDER

(75) Inventor: Charles B. Perez, Jr., Venice, CA (US)

(73) Assignee: The Licensing Group, Inc., Los Angeles, CA (US)

( * ) Notice: Subject to any disclaimer, the term of this patent is extended or adjusted under 35 U.S.C. 154(b) by 785 days.

(21) Appl. No.: 11/533,075

(22) Filed: Sep. 19, 2006

(65) Prior Publication Data

US 2007/0062058 A1 Mar. 22, 2007

Related U.S. Application Data

(60) Provisional application No. 60/718,716, filed on Sep. 19, 2005.

(51) Int. Cl.
*A45D 20/12* (2006.01)
*F26B 25/18* (2006.01)

(52) U.S. Cl. ..... 34/96; 34/90; 34/97; 248/205.5; 248/205.8; 248/160

(58) Field of Classification Search ..... 34/90, 91, 34/96, 97; 392/380, 382, 383; 248/205.9, 248/205.8, 205.5, 104, 160; 24/129 R, 131 R, 24/129 C See application file for complete search history.

(56) References Cited

U.S. PATENT DOCUMENTS

| | | | | | |
|---|---|---|---|---|---|
| 774,719 | A * | 11/1904 | Estes | 24/714 |
| 3,020,017 | A * | 2/1962 | Watson | 248/205.8 |
| 3,180,604 | A * | 4/1965 | Hammer | 248/205.8 |
| 3,612,563 | A * | 10/1971 | Kazmark, Sr. | 280/655 |
| 3,817,433 | A * | 6/1974 | Thomas | 294/3.6 |
| 4,225,106 | A * | 9/1980 | Eplan | 248/282.1 |
| 4,696,447 | A * | 9/1987 | Strecker | 248/206.3 |
| 5,630,517 | A * | 5/1997 | Maznik | 248/205.5 |
| 5,761,825 | A * | 6/1998 | Ammon et al. | 34/97 |
| 5,842,670 | A * | 12/1998 | Nigoghosian | 248/160 |
| 5,881,983 | A * | 3/1999 | Hofmann et al. | 248/274.1 |
| 5,937,537 | A * | 8/1999 | Miller | 34/97 |
| 5,956,861 | A | 9/1999 | Barnes | |
| 6,026,590 | A * | 2/2000 | Picozza et al. | 34/90 |
| 6,061,923 | A | 5/2000 | Case | |
| 6,189,229 | B1 | 2/2001 | Thomas et al. | |
| 6,205,679 | B1 * | 3/2001 | Rodway et al. | 34/90 |
| 6,390,424 | B1 * | 5/2002 | Kidushim et al. | 34/97 |
| 6,457,686 | B1 * | 10/2002 | Hill | 248/205.5 |
| 6,520,467 | B2 * | 2/2003 | Thomas et al. | 248/309.3 |

* cited by examiner

*Primary Examiner* — Jiping Lu
(74) *Attorney, Agent, or Firm* — Kelly & Kelley, LLP

(57) ABSTRACT

A universal hair dryer holder includes a base including suction mechanism for releasably attaching the base to a generally flat surface and an adjustable arm extending from the base. The holder also includes a cradle for holding a hair dryer at an end of the arm opposite the base.

1 Claim, 2 Drawing Sheets

UNIVERSAL HAND-HELD HAIR DRYER HOLDER

BACKGROUND OF THE INVENTION

The present invention generally relates to hand-held hair dryers. More particularly, the present invention relates to a universal holder for such hand-held hair dryers to permit a user to utilize both hands when brushing and styling his or her hair.

Many people utilize a portable hand-held hair dryer to dry their hair, such as after taking a bath or shower. Typically, the hair dryer is stored in a drawer or cabinet underneath the bathroom sink. This must be retrieved and plugged into an electrical outlet adjacent to the sink. The user then holds the hair dryer with one hand while combing or brushing the hair with the other hand. Although his procedure has been in use for many decades, it presents several drawbacks. First, the user has difficulty styling his or her hair with only one hand. Another disadvantage is that when placing the hair dryer on the counter-top, such as when needing both hands to style the hair, there exists the possibility that the hair dryer could fall into a sink or otherwise come into contact with water, possible damaging the hair dryer or creating an electrocution hazard.

There do exist wall-mounted hair dryers, such as those used in hotels and the like. These hair dryers are typically different in configuration and shape and size as compared to conventional hand-held portable hair dryers. A bracket or the like is mounted directly to the wall, and sometimes recessed within the wall, and hair dryer can be selectively removed from and inserted into the bracket to hold the hair dryer on to the wall. While overcoming the problem of storage and potential water damage or electrocution hazard, such devices do not solve the problem of freeing both hands to style one's hair, while simultaneously blow drying the hair.

Various attempts have been made to overcome the problems associated with conventional hair dryer holders. For example, U.S. Pat. No. 5,761,825 discloses a hands free hair dryer and holder. However, this device is permanently mounted to a wall and not easily fixed to various surfaces. In another example, U.S. Pat. No. 5,956,861 discloses a wall mounted portable hair dryer holder. However, this device also lacks the versatility that comes with being able to be non-permanently mounted to more than one surface. In a further example, U.S. Pat. No. 6,061,923 discloses a wall-mounted extendable hair dyer holder. However, this device must be mounted to the wall and cannot be mounted to a horizontal surface.

Accordingly, there is a continuing need for an apparatus which enables a user to simultaneously blow dry his or her hair while freeing both hands to brush and style the hair. There is an additional need for a hair dryer holder that is simple and economical to manufacture. The present invention fulfills these needs and provides other related advantages.

SUMMARY OF THE INVENTION

The present invention resides in an apparatus that provides a universal hand-held dryer holder. As illustrated herein, an embodiment of a universal hair dryer holder includes a base including suction mechanism for releasably attaching the base to a generally flat surface and an adjustable arm extending from the base. The holder also includes a cradle for holding a hair dryer at an end of the arm opposite the base.

The adjustable arm is selectively bendable along its length.

The hair dryer holder also has a mechanism for retaining the hair dryer on the cradle. The retaining mechanism includes a flexible band attachable to the cradle for releasably securing the hair dryer within the cradle.

The suction mechanism includes a diaphragm moveable between a generally flat configuration parallel with the surface and a configuration partially-raised above the surface in order to create a vacuum therebetween and rigidly fix the base to the surface. The base includes a lever for selectively actuating the suction mechanism.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
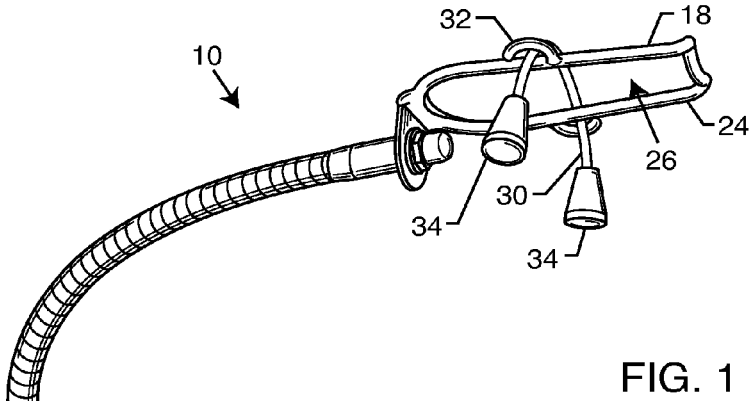
FIG. 1 is a perspective view of a universal hand-held hair dryer holder embodying the present invention.

As shown in the accompanying drawings, for purpose of illustration, the present invention resides in a universal hand-held hair dryer holding device, generally referred to by the reference number 10. As illustrated in FIG. 1, the device 10 is used to hold a portable hand-held hair dryer 12 securely on a counter-top or the like so as to be selectively positioned at the user's hair.

Figure 2:
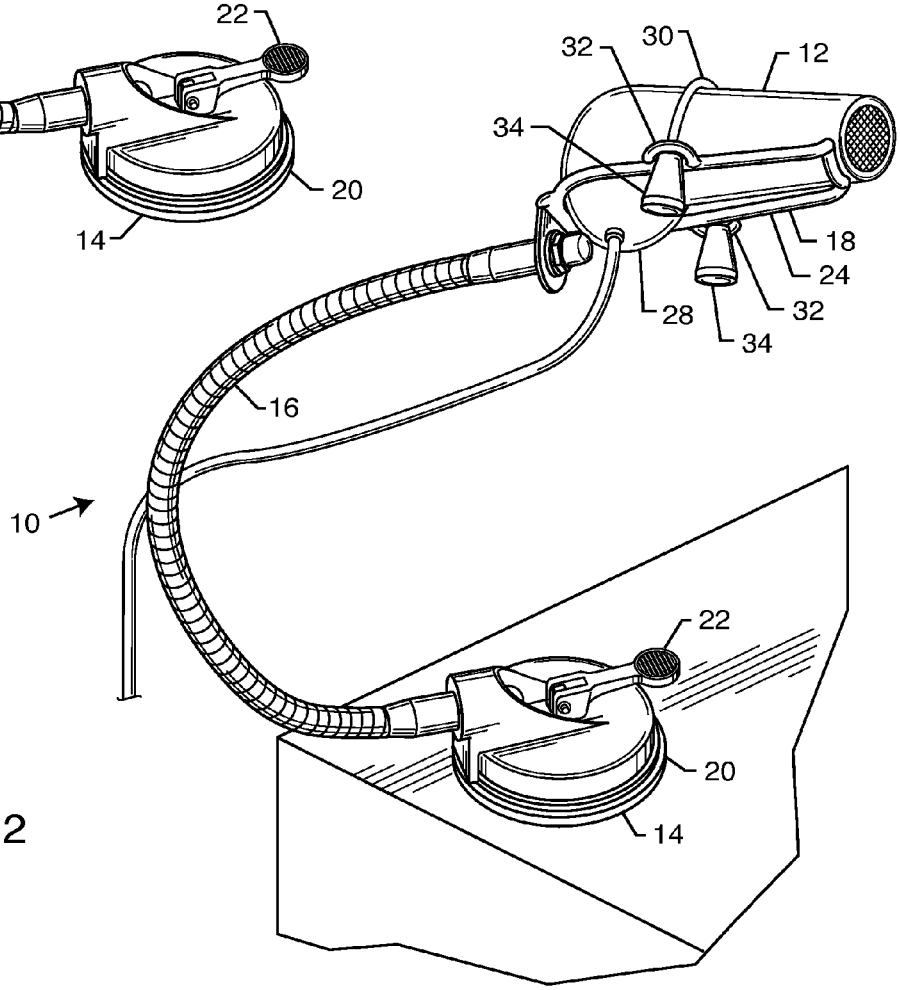
FIG. 2 is a perspective view of the universal hand-held hair dryer holder of FIG. 1, with a portable hand-held hair dryer supported therein as the holder engages a flat surface.
Figure 3:
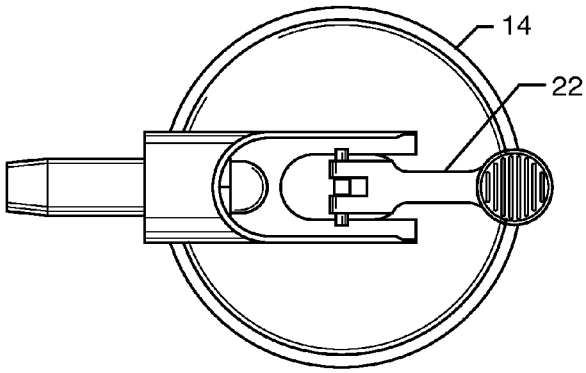
FIG. 3 is a top plan view of the base of the holder of FIG. 1.
Figure 4:
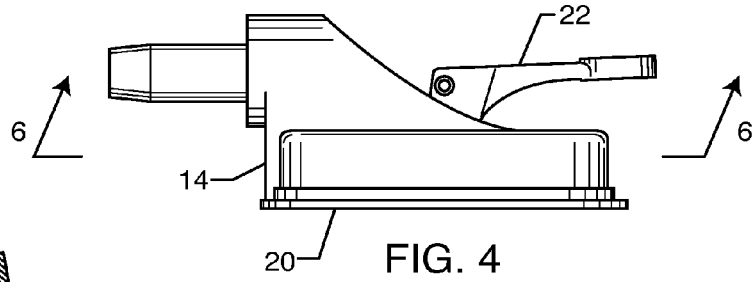
FIG. 4 is a side elevation view of the base of FIG. 3.
Figure 5:
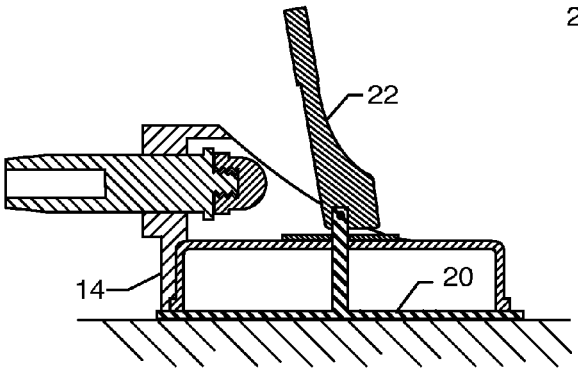
FIG. 5 is a cross-sectional view of the base, illustrating the suction mechanism in a relaxed configuration with respect to the flat surface.
Figure 6:
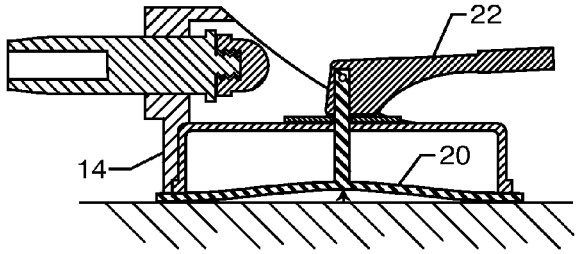
FIG. 6 is a cross-sectional view of the base, taken generally along line 6-6 of FIG. 4, illustrating the suction mechanism in a configuration where the holder is engaging the flat surface.

With reference to FIGS. 1 and 2, the holding apparatus 10 is generally comprised of a suction cup base 14, a flexible, adjustable arm 16, and a saddle or cradle 18. As illustrated in FIG. 1, the base 14 is adapted to be removably attached to a counter-top or other generally horizontal flat surface. The flexible arm 16 positions the saddle 18, and thus the hair dryer 12 at the selected height and position which enables a user to simultaneously blow dry his or her hair (or someone else's hair) while freeing both hands to brush and style the hair.

The base 14 in a particularly preferred embodiment comprises a suction cup so as to be selectively attached to a flat surface by suction. As such, the base 14 includes a diaphragm 20 comprised of a resilient elastomeric material, such as rubber or the like, on a bottom surface thereof. The diaphragm 20 is raised and lowered by a lever 22. The lever 22 is positioned and sized so as to be easily manipulated by the fingers of the user. In the illustrated embodiment, pushing the lever 22 downwardly causes the diaphragm 20 to be moved downward and into its relaxed position. This enables the device 10 to be removed from flat surface for repositioning, storage, etc.

Upon being placed on a generally flat surface to which suction is possible, such as wood, glass, porcelain, plastic, etc., the lever 22 is lifted, causing the central portion of the diaphragm 20 to be lifted and create a vacuum thereunder. This causes the base 14 to be rigidly fixed to the horizontal surface, as illustrated in FIG. 1.

The flexible arm 16 extending from the base 14 is a mechanism for positioning the hair dryer 12 in a selected position relative to hair that a user desires to style, and configured such so as to be manipulated into a desired shape and retain that shape. As such, the flexible arm 16 may be comprised of a material, flexible tubing or rod which has such characteristics. As illustrated, the flexible arm 16 is of gooseneck-type assembly wherein a plurality of segments are pivotally connected to one another such that the user can alter the shape of the flexible arm 16 into almost any desired configuration and shape which will be held until the user physically manipulates the arm 16 again. The arm 16 is of a sufficient length so as to position the saddle 18 adjacent to a head of a user.

Figure 7:
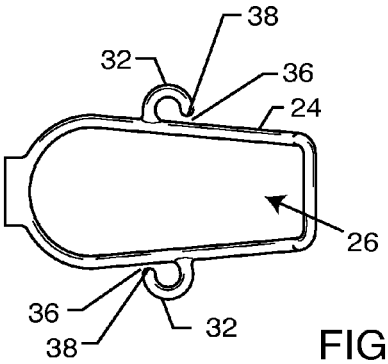
FIG. 7 is a top view of the cradle in FIG. 1, illustrating a pair of hooks extending from opposite sides of the cradle and forming gaps therebetween.

At the end of the arm 16, generally opposite the base 14, is the saddle or cradle 18 which is designed and configured so as to hold many different types of hair dryers, so as to be universal in nature. The saddle 18 includes a wire holder 24 in the form of an elongated circle, C-shaped member or the like so as to form an opening 26 therein. The cradle 18 may include a non-slip pad or layer of material to maintain the hair dryer 12 therein. A handle 28 or some other portion of the hair dryer 12 extends through the opening 26, while the remainder of the hair dryer 12 is supported underneath by the wire bracket 24. In a particularly preferred embodiment, as illustrated, the cradle 18 also includes a retainer 30 which is typically comprised of an elastic material such as a rubber cord or a bungee cord which can be stretched to accommodate hair dryers 12 of different sizes. The flexible retainer 30 serves to hold the hair dryer 12 onto the wire bracket base 24 to prevent the hair dryer 12 from inadvertently slipping away from the saddle 18. The flexible retainer 30 can come in various forms including, without limitation, a flexible band. The flexible retainer 30 engages a pair of hooks 32, each hook 32 extending from opposite sides of the cradle 18. The flexible retainer 30 includes a knob 34 on each end such that engagement of the knobs 34 and the hooks 32 firmly retains the dryer 12 on the cradle 18, as seen in FIG. 2. The band of the flexible retainer 30 is thin enough so as to slip into an open space 36 (FIG. 7) between the wire frame 24 and each end of the hooks 32. FIG. 7 illustrates the flexible retainer 30 inserted between the wire frame 24 and a free end 38 of the hooks 32.

In use, the user finds an appropriate spot on the bathroom counter or the like, and secures the base 14 onto the countertop by actuating the lever 22, as described above, to create a suction attachment of the base 14 to the counter, as illustrated in FIG. 1. The hair dryer 12 is secured into the saddle 18 and moved into the intended position adjacent the user's hair. The flexible arm 16 will automatically be moved into proper position by positioning the hair dryer 12 and saddle 18. Due to the nature of the flexible arm 16, the hair dryer 12 will remain in place. Dry warm air is then blown into the user's hair as the user has both hands free to comb and style his or her hair.

The above-described embodiment of the present invention is illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A universal hair dryer holder, comprising:

a hair dryer;

a base including suction means for releasably attaching the base to a generally flat surface and a lever for selectively actuating the suction means;

an adjustable arm selectively bendable along its length, extending from the base;

a wire holder cradle defining an aperture for insertion of a handle of the hair dryer therein to hold the hair dryer at an end of the arm opposite the base;

a pair of curved hooks extending from generally opposite sides of the cradle, the curved hooks oriented opposite to one another; and an elastic cord slidably disposed within the curved hooks and partially encompassing the exterior of the hair dryer, the elastic cord comprising a stretchable band and a pair of rigid knobs at opposite ends of the stretchable band, the stretchable band having a width to fit through a gap between a free end of the curved hook and the cradle and the pair of knobs sized to engage the pair of curved hooks to prevent movement of the hair dryer, the elastic cord being selectively releasible from the cradle by stretching the band to disengage the knobs from the curved hooks in order to slidingly remove the stretchable band from within the curved hooks via a gap;

wherein the suction means comprises a diaphragm moveable between a generally flat configuration parallel with the surface and a configuration partially-raised above the surface in order to create a vacuum therebetween and rigidly fix the base to the surface.

* * * * *